US010177457B1

(12) United States Patent
Brown

(10) Patent No.: US 10,177,457 B1
(45) Date of Patent: Jan. 8, 2019

(54) FREE-SPACE MATCHED WAVEGUIDE FLANGE

(71) Applicant: Waymo LLC, Mountain View, CA (US)

(72) Inventor: Adam Brown, Mountain View, CA (US)

(73) Assignee: Waymo LLC, Mountain View, CA (US)

( * ) Notice: Subject to any disclaimer, the term of this patent is extended or adjusted under 35 U.S.C. 154(b) by 26 days.

(21) Appl. No.: 15/141,306

(22) Filed: Apr. 28, 2016

(51) Int. Cl.

| | |
|---|---|
| ***H01Q 13/02*** | (2006.01) |
| ***H01Q 13/08*** | (2006.01) |
| ***H01P 7/06*** | (2006.01) |
| ***H01P 1/00*** | (2006.01) |
| *H01Q 13/06* | (2006.01) |

(52) U.S. Cl.
CPC ..... *H01Q 13/0266* (2013.01); *H01P 1/00* (2013.01); *H01P 7/06* (2013.01); *H01Q 13/085* (2013.01); *H01Q 13/065* (2013.01)

(58) Field of Classification Search
CPC ..... H01Q 13/0266; H01Q 13/085; H01Q 13/065; H01P 1/00; H01P 7/06; H01P 1/042
See application file for complete search history.

(56) References Cited

U.S. PATENT DOCUMENTS

| | | | | |
|---|---|---|---|---|
| 3,569,974 | A * | 3/1971 | McLeod, Jr. | H01Q 3/46 333/21 R |
| 5,387,884 | A * | 2/1995 | Porcello | H01P 1/042 333/253 |
| 6,239,669 | B1 * | 5/2001 | Koriyama | H01L 23/66 333/247 |
| 2009/0058747 | A1 | 3/2009 | Haziza | |
| 2011/0063053 | A1 | 3/2011 | Guler | |
| 2013/0241788 | A1 | 9/2013 | Anderson | |
| 2016/0043475 | A1 | 2/2016 | Izadian | |
| 2016/0047893 | A1 | 2/2016 | Izadian | |

* cited by examiner

*Primary Examiner* — Jessica Han
*Assistant Examiner* — Michael Bouizza
(74) *Attorney, Agent, or Firm* — McDonnell Boehnen Hulbert & Berghoff LLP

(57) ABSTRACT

An apparatus includes a first waveguide configured to propagate electromagnetic energy along a propagation direction. The apparatus further includes a first waveguide flange configured to selectively operate in one of a plurality of modes. When operating in a first mode, the apparatus radiates at least a portion of the electromagnetic energy from the first waveguide via at least one radiating feature of the first waveguide flange. The at least one radiating feature is located on a surface of the first waveguide flange that is perpendicular to the propagation direction. Additionally, when operating in a second mode, the apparatus conducts at least a portion of the electromagnetic energy from the first waveguide to a subsequent element (e.g., a second waveguide). The at least one radiating feature is shorted to a portion of the subsequent element when operating in the second mode.

20 Claims, 9 Drawing Sheets

FREE-SPACE MATCHED WAVEGUIDE FLANGE

BACKGROUND

Unless otherwise indicated herein, the materials described in this section are not prior art to the claims in this application and are not admitted to be prior art by inclusion in this section.

Radio detection and ranging (RADAR) systems can be used to actively estimate distances to environmental features by emitting radio signals and detecting returning reflected signals. Distances to radio-reflective features can be determined according to the time delay between transmission and reception. The radar system can emit a signal that varies in frequency over time, such as a signal with a time-varying frequency ramp, and then relate the difference in frequency between the emitted signal and the reflected signal to a range estimate. Some systems may also estimate relative motion of reflective objects based on Doppler frequency shifts in the received reflected signals.

Directional antennas can be used for the transmission and/or reception of signals to associate each range estimate with a bearing. More generally, directional antennas can also be used to focus radiated energy on a given field of view of interest. Combining the measured distances and the directional information allows for the surrounding environment features to be mapped. The radar sensor can thus be used, for instance, by an autonomous vehicle control system to avoid obstacles indicated by the sensor information.

Some example automotive radar systems may be configured to operate at an electromagnetic wave frequency of 77 Giga-Hertz (GHz), which corresponds to a millimeter (mm) wave electromagnetic wave length (e.g., 3.9 mm for 77 GHz). These radar systems may use antennas that can focus the radiated energy into tight beams in order to enable the radar system to measure an environment with high accuracy, such as an environment around an autonomous vehicle. Such antennas may be compact (typically with rectangular form factors), efficient (i.e., with little of the 77 GHz energy lost to heat in the antenna or reflected back into the transmitter electronics), and low cost and easy to manufacture (i.e., radar systems with these antennas can be made in high volume).

SUMMARY

Disclosed herein are embodiments that relate to methods and apparatuses for waveguides. In one aspect, the present application describes an apparatus including a first waveguide configured to propagate electromagnetic energy along a propagation direction. The apparatus further includes a first waveguide flange configured to selectively operate in one of a plurality of modes. When operating in a first mode, the apparatus radiates at least a portion of the electromagnetic energy from the first waveguide via at least one radiating feature of the first waveguide flange. The at least one radiating feature is located on a surface of the first waveguide flange that is perpendicular to the propagation direction. Additionally, when operating in a second mode, the apparatus conducts at least a portion of the electromagnetic energy from the first waveguide to a subsequent element. The at least one radiating feature is shorted to a portion of the subsequent element when operating in the second mode.

In another aspect, the present application describes a method. The method includes conducting electromagnetic energy in a first waveguide along a propagation direction. The method also includes operating a first waveguide flange in one of a plurality of modes. Operating in a first mode includes radiating at least a portion of the electromagnetic energy from the first waveguide via at least one radiating feature of the first waveguide flange. The at least one radiating feature is located on a surface of the first waveguide flange that is perpendicular to the direction of propagation. Operating in a second mode includes conducting at least a portion of the electromagnetic energy from the first waveguide to a subsequent element, where the at least one radiating feature is shorted to a portion of the subsequent element.

In yet another example, a system is provided. The system includes a waveguide configured to propagate electromagnetic energy along a propagation direction. The system also includes a first waveguide flange configured to selectively operate in one of a plurality of modes. When operating in a first mode, the system radiates at least a portion of the electromagnetic energy from the waveguide via at least one radiating feature of the first waveguide flange. The at least one radiating feature is located on a surface of the first waveguide flange that is perpendicular to the propagation direction. When operating in a second mode, the system conducts at least a portion of the electromagnetic energy from the first waveguide to a second waveguide coupled to the first waveguide via the first and a second waveguide flange.

In another aspect, the present application describes an apparatus. The apparatus includes means for conducting electromagnetic energy along a propagation direction. The apparatus also includes operating a means for termination in one of a plurality of modes. Operating in a first mode includes means for radiating at least a portion of the electromagnetic energy via at least one radiating means of the means for termination. The at least one radiating means is located on a surface of the termination means that is perpendicular to the direction of propagation. Operating in a second mode includes means for conducting at least a portion of the electromagnetic energy to a subsequent means, where the at least one radiating means is shorted to a portion of the subsequent means.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
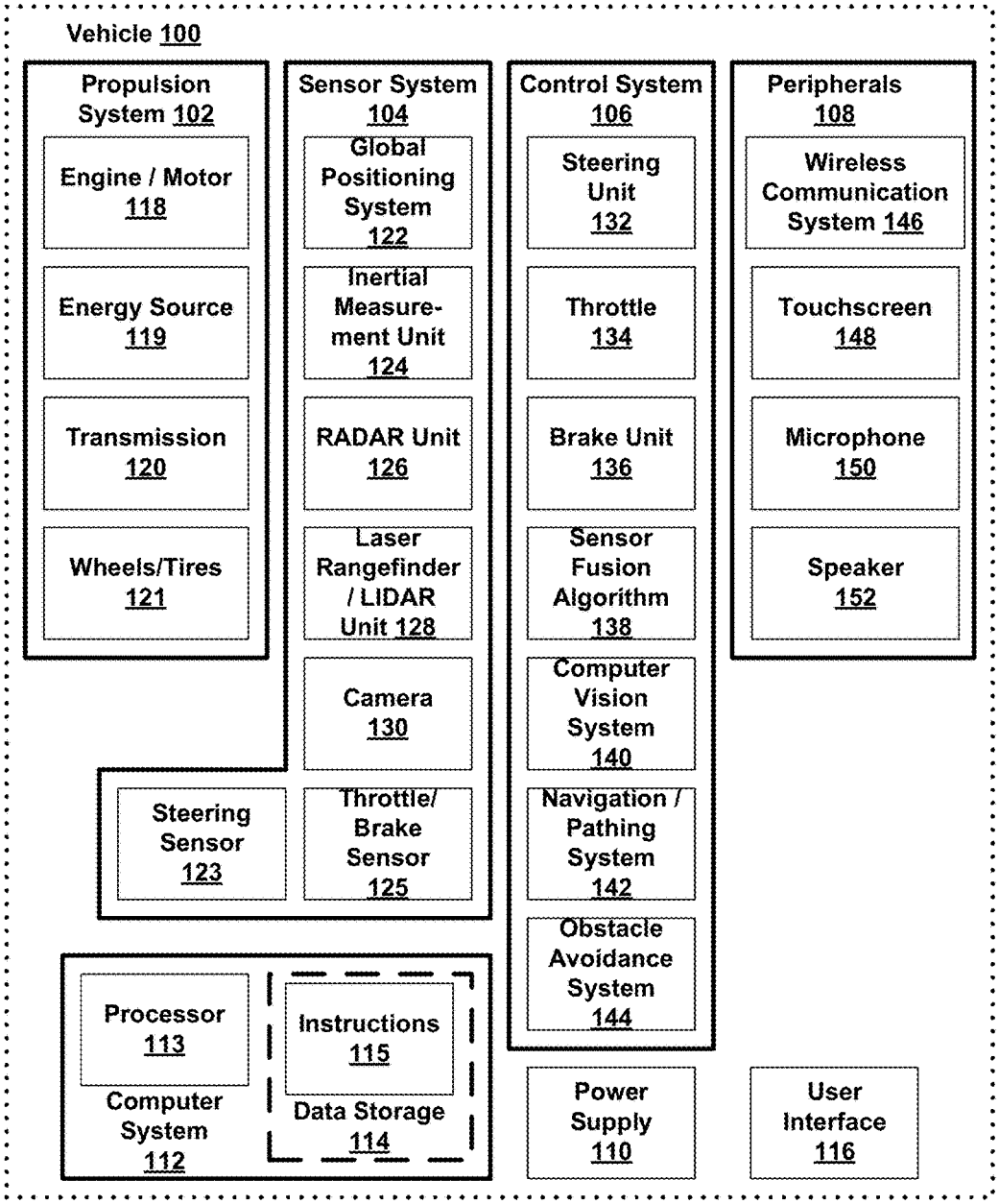
FIG. 1 is a functional block diagram illustrating a vehicle, according to an example embodiment.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following detailed description relates to an apparatus and methods for a free-space matched waveguide flange. One aspect of the present disclosure provides an apparatus for the calibration and/or testing of electromagnetic waveguide systems. Waveguides may be used to guide and propagate electromagnetic signals in both radar and antenna systems. Although waveguides offer an efficient way to conduct electromagnetic energy, the points where waveguides couple to other objects can present design difficulties. A waveguide may include a flange configured to allow different objects to couple to the waveguide. The objects coupled to a waveguide may include an additional waveguide, an antenna, or other electromagnetic elements. The disclosed apparatus and methods may be used to reduce or mitigate undesired effects caused by an impedance discontinuity caused by a traditional waveguide flange. As used herein, the terms electromagnetic energy, electromagnetic signals, signals, electromagnetic waves, and waves may be used interchangeably to denote the electromagnetic energy that is used with the systems and methods.

When testing or operating a waveguide system, various signals may be propagated through the waveguide system. The waveguide system may include multiple waveguides each ending with a flange. Traditionally, each flange would either be coupled to a subsequent element or terminated with a matched load for proper operation of the waveguide system. If a waveguide flange was left open (i.e. nothing connected to it), a portion of the electromagnetic energy in the waveguide would be radiated and the other portion would be reflected back into the waveguide system. Energy reflected back into the system may cause undesired effects and may cause errors in various measurements of the waveguide system. However, while testing a waveguide system, continuously removing or adding matched loads (to minimize or reduce internal system reflections) to various waveguide flanges may be a time-consuming process. The disclosed system and methods may make testing and operation of waveguide systems more efficient.

A waveguide flange disclosed herein may include various radiating elements on an external surface of the flange. The external surface of the flange may be perpendicular to the direction of propagation of the electromagnetic energy down the waveguide. These radiating elements may cause the flange to have an impedance matched to the waveguide. By having an impedance match, reflected electromagnetic energy may be minimized or reduced. Additionally, these elements may cause the flange of the waveguide to radiate electromagnetic energy. By designing these elements in a correct manner, the radiation pattern of the radiated electromagnetic energy may be controlled based on a predetermined radiation pattern. By radiating electromagnetic energy with a known radiation pattern, performance measurements of the waveguide system may be calculated by measuring the far field of the electromagnetic energy. In some examples, the radiating elements of the waveguide flange may be radiating slots. Various other radiating elements may be used as well.

Additionally, the presently disclose waveguide flange is backwards compatible with a standard flange. That means that if the radiating waveguide flange is coupled to a traditional waveguide flange it functions like a traditional flange to allow the radiation to couple between the two waveguides. In some examples, when two flanges are brought together it causes a shorting of the radiating components. By shorting the radiating components, they are effectively removed from the system.

A radar system of an autonomous vehicle may include a plurality of antennas. Each antenna may be configured to (i) transmit electromagnetic signals, (ii) receive electromagnetic signals, or (iii) both transmit and receive electromagnetic signals. The antennas may form an array of antenna elements. Each antenna of the array may be fed (i.e., supplied with a signal) from a waveguide. Additionally, the waveguide may communicate signals received by the various antennas to a receiver within the radar system.

A waveguide is a structure that conducts electromagnetic energy from one location to another location. In some instances, conducting electromagnetic energy with a waveguide has the advantage of having less loss than other conduction means. A waveguide will typically have less loss than other conduction means because the electromagnetic energy is conducted through a very low loss medium. For example, the electromagnetic energy of a waveguide may be conducted through air or a low loss dielectric.

In one embodiment, such as an air-filled waveguide, the waveguide will have a metallic outer conductor. However, in other embodiments, the waveguide may be formed by just the dielectric medium through which the energy propagates. In either embodiment, the size and shape of the waveguide define the propagation of the electromagnetic energy. For example, electromagnetic energy may bounce (or reflect) off the metallic walls of waveguide. In other embodiments, a dielectric medium may fully contain the electromagnetic energy (such as fiber optic transmission).

Based on the shape and the materials of the waveguide, the propagation of the electromagnetic energy will vary. The shape and the materials of the waveguide define the boundary conditions for the electromagnetic energy. Boundary conditions are known conditions for the electromagnetic energy at the edges of the waveguide. For example, in the metallic waveguide, assuming the waveguide walls are nearly perfectly conducting, the boundary conditions specify that there is no tangentially directed electric field at any of the wall sides. Once the boundary conditions are known, Maxwell's Equations can be used to determine how electromagnetic energy propagates through the waveguide.

Maxwell's Equations will define several modes of operation for any given waveguide. Each mode defines one specific way in which electromagnetic energy can propagate through the waveguide. Each mode has an associated cutoff frequency. A mode is not supported in a waveguide if the electromagnetic energy has a frequency that is below the cutoff frequency. By properly selecting both (i) waveguide dimensions and (ii) frequency of operation, electromagnetic energy may propagate through the waveguide in a specific mode. Often, waveguides are designed so only one propagation mode is supported at the design frequency.

There are four main types of waveguide propagation modes: Transverse Electric (TE) modes, Transverse Magnetic (TM) modes, Transverse Electromagnetic (TEM) modes, and Hybrid modes. In TE modes, the electromagnetic energy has no electric field in the direction of the electromagnetic energy propagation. In TM modes, the electromagnetic energy has no magnetic field in the direction of the electromagnetic energy propagation. In TEM modes, the electromagnetic energy has no electric or magnetic field in the direction of the electromagnetic energy propagation. In Hybrid modes, the electromagnetic energy has some of both electric field and magnetic field the direction of the electromagnetic energy propagation.

TE, TM, and TEM modes can be further specified using two suffix numbers that correspond to two directions orthogonal to the direction of propagation, such as a width direction and a height direction. A non-zero suffix number indicates the respective number of half-wavelengths of the electromagnetic energy equal to the width and height of the waveguide. However, a suffix number of zero indicates that there is no variation of the field with respect to that direction. For example, a $TE_{10}$ mode indicates the waveguide is half-wavelength in width and there is no field variation in the height direction. Typically, when the suffix number is equal to zero, the dimension of the waveguide in the respective direction is less than one-half of a wavelength. In another example, a $TE_{21}$ mode indicates the waveguide is one wavelength in width (i.e. two half wavelengths) and one half wavelength in height.

When operating a waveguide in a TE mode, the suffix numbers also indicate the number of field-maximums along the respective direction of the waveguide. For example, a $TE_{10}$ mode indicates that the waveguide has one electric field maximum in the width direction and zero maxima in the height direction. In another example, a $TE_{21}$ mode indicates that the waveguide has two electric field maxima in the width direction and one maximum in the height direction.

Example systems within the scope of the present disclosure will now be described in greater detail. An example system with which the free-space matched waveguide flange may be used may be implemented in or may take the form of an automobile, a system to test radar capabilities of an automobile having radar, and any type of waveguide system. However, an example system may also be implemented in or take the form of other vehicles, such as cars, trucks, motorcycles, buses, boats, airplanes, helicopters, lawn mowers, earth movers, boats, snowmobiles, aircraft, recreational vehicles, amusement park vehicles, farm equipment, construction equipment, trams, golf carts, trains, and trolleys. Other objects that use waveguides are possible to use with the free-space matched waveguide flange as well.

FIG. 1 is a functional block diagram illustrating a vehicle 100, according to an example embodiment. The vehicle 100 could be configured to operate fully or partially in an autonomous mode. For example, a computer system could control the vehicle 100 while in the autonomous mode, and may be operable to transmit a radio signal, receive reflected radio signals with at least one antenna in the radar system, process the received reflected radio signals, locate the objects that caused the reflections, and calculate an angle and a distance to each object that reflected the radio signal. While in autonomous mode, the vehicle 100 may be configured to operate without human interaction.

The vehicle 100 could include various subsystems such as a propulsion system 102, a sensor system 104, a control system 106, one or more peripherals 108, as well as a power supply 110, a computer system 112, a data storage 114, and a user interface 116. The vehicle 100 may include more or fewer subsystems and each subsystem could include multiple elements. Further, each of the subsystems and elements of vehicle 100 could be interconnected. Thus, one or more of the described functions of the vehicle 100 may be divided up into additional functional or physical components, or combined into fewer functional or physical components. In some further examples, additional functional and/or physical components may be added to the examples illustrated by FIG. 1.

The propulsion system 102 may include components operable to provide powered motion for the vehicle 100. Depending upon the embodiment, the propulsion system 102 could include an engine/motor 118, an energy source 119, a transmission 120, and wheels/tires 121. The engine/motor 118 could be any combination of an internal combustion engine, an electric motor, steam engine, Stirling engine. Other motors and/or engines are possible. In some embodiments, the engine/motor 118 may be configured to convert energy source 119 into mechanical energy. In some embodiments, the propulsion system 102 could include multiple types of engines and/or motors. For instance, a gas-electric hybrid car could include a gasoline engine and an electric motor. Other examples are possible.

The energy source 119 could represent a source of energy that may, in full or in part, power the engine/motor 118. Examples of energy sources 119 contemplated within the scope of the present disclosure include gasoline, diesel, other petroleum-based fuels, propane, other compressed gas-based fuels, ethanol, solar panels, batteries, and other sources of electrical power. The energy source(s) 119 could additionally or alternatively include any combination of fuel tanks, batteries, capacitors, and/or flywheels. The energy source 118 could also provide energy for other systems of the vehicle 100.

The transmission 120 could include elements that are operable to transmit mechanical power from the engine/motor 118 to the wheels/tires 121. The transmission 120 could include a gearbox, a clutch, a differential, and a drive shaft. Other components of transmission 120 are possible. The drive shafts could include one or more axles that could be coupled to the one or more wheels/tires 121.

The wheels/tires 121 of vehicle 100 could be configured in various formats, including a unicycle, bicycle/motorcycle, tricycle, or car/truck four-wheel format. Other wheel/tire geometries are possible, such as those including six or more wheels. Any combination of the wheels/tires 121 of vehicle 100 may be operable to rotate differentially with respect to other wheels/tires 121. The wheels/tires 121 could represent at least one wheel that is fixedly attached to the transmission 120 and at least one tire coupled to a rim of the wheel that could make contact with the driving surface. The wheels/tires 121 could include any combination of metal and rubber. Other materials are possible.

The sensor system 104 may include several elements such as a Global Positioning System (GPS) 122, an inertial measurement unit (IMU) 124, a radar 126, a laser rangefinder/LIDAR 128, a camera 130, a steering sensor 123, and a throttle/brake sensor 125. The sensor system 104 could also include other sensors, such as those that may monitor internal systems of the vehicle 100 (e.g., $O_2$ monitor, fuel gauge, engine oil temperature, brake wear).

The GPS 122 could include a transceiver operable to provide information regarding the position of the vehicle 100 with respect to the Earth. The IMU 124 could include a combination of accelerometers and gyroscopes and could represent any number of systems that sense position and orientation changes of a body based on inertial acceleration. Additionally, the IMU 124 may be able to detect a pitch and yaw of the vehicle 100. The pitch and yaw may be detected while the vehicle is stationary or in motion.

The radar 126 may represent a system that utilizes radio signals to sense objects, and in some cases their speed and heading, within the local environment of the vehicle 100. Additionally, the radar 126 may have a plurality of antennas configured to transmit and receive radio signals. The laser rangefinder/LIDAR 128 could include one or more laser sources, a laser scanner, and one or more detectors, among other system components. The laser rangefinder/LIDAR 128 could be configured to operate in a coherent mode (e.g., using heterodyne detection) or in an incoherent detection mode. The camera 130 could include one or more devices configured to capture a plurality of images of the environment of the vehicle 100. The camera 130 could be a still camera or a video camera.

The steering sensor 123 may represent a system that senses the steering angle of the vehicle 100. In some embodiments, the steering sensor 123 may measure the angle of the steering wheel itself. In other embodiments, the steering sensor 123 may measure an electrical signal representative of the angle of the steering wheel. Still, in further embodiments, the steering sensor 123 may measure an angle of the wheels of the vehicle 100. For instance, an angle of the wheels with respect to a forward axis of the vehicle 100 could be sensed. Additionally, in yet further embodiments, the steering sensor 123 may measure a combination (or a subset) of the angle of the steering wheel, electrical signal representing the angle of the steering wheel, and the angle of the wheels of vehicle 100.

The throttle/brake sensor 125 may represent a system that senses the position of either the throttle position or brake position of the vehicle 100. In some embodiments, separate sensors may measure the throttle position and brake position. In some embodiments, the throttle/brake sensor 125 may measure the angle of both the gas pedal (throttle) and brake pedal. In other embodiments, the throttle/brake sensor 125 may measure an electrical signal that could represent, for instance, an angle of a gas pedal (throttle) and/or an angle of a brake pedal. Still, in further embodiments, the throttle/brake sensor 125 may measure an angle of a throttle body of the vehicle 100. The throttle body may include part of the physical mechanism that provides modulation of the energy source 119 to the engine/motor 118 (e.g., a butterfly valve or carburetor). Additionally, the throttle/brake sensor 125 may measure a pressure of one or more brake pads on a rotor of vehicle 100. In yet further embodiments, the throttle/brake sensor 125 may measure a combination (or a subset) of the angle of the gas pedal (throttle) and brake pedal, electrical signal representing the angle of the gas pedal (throttle) and brake pedal, the angle of the throttle body, and the pressure that at least one brake pad is applying to a rotor of vehicle 100. In other embodiments, the throttle/brake sensor 125 could be configured to measure a pressure applied to a pedal of the vehicle, such as a throttle or brake pedal.

The control system 106 could include various elements include steering unit 132, throttle 134, brake unit 136, a sensor fusion algorithm 138, a computer vision system 140, a navigation/pathing system 142, and an obstacle avoidance system 144. The steering unit 132 could represent any combination of mechanisms that may be operable to adjust the heading of vehicle 100. The throttle 134 could control, for instance, the operating speed of the engine/motor 118 and thus control the speed of the vehicle 100. The brake unit 136 could be operable to decelerate the vehicle 100. The brake unit 136 could use friction to slow the wheels/tires 121. In other embodiments, the brake unit 136 could convert the kinetic energy of the wheels/tires 121 to electric current.

A sensor fusion algorithm 138 could include, for instance, a Kalman filter, Bayesian network, or other algorithm that may accept data from sensor system 104 as input. The sensor fusion algorithm 138 could provide various assessments based on the sensor data. Depending upon the embodiment, the assessments could include evaluations of individual objects and/or features, evaluation of a particular situation, and/or evaluate possible impacts based on the particular situation. Other assessments are possible.

The computer vision system 140 could include hardware and software operable to process and analyze images in an effort to determine objects, important environmental features (e.g., stop lights, roadway boundaries, etc.), and obstacles. The computer vision system 140 could use object recognition, Structure From Motion (SFM), video tracking, and other algorithms used in computer vision, for instance, to recognize objects, map an environment, track objects, estimate the speed of objects, etc.

The navigation/pathing system 142 could be configured to determine a driving path for the vehicle 100. The navigation/pathing system 142 may additionally update the driving path dynamically while the vehicle 100 is in operation. In some embodiments, the navigation/pathing system 142 could incorporate data from the sensor fusion algorithm 138, the GPS 122, and known maps so as to determine the driving path for vehicle 100.

The obstacle avoidance system 144 could represent a control system configured to evaluate potential obstacles based on sensor data and control the vehicle 100 to avoid or otherwise negotiate the potential obstacles.

Various peripherals 108 could be included in vehicle 100. For example, peripherals 108 could include a wireless communication system 146, a touchscreen 148, a microphone 150, and/or a speaker 152. The peripherals 108 could provide, for instance, means for a user of the vehicle 100 to interact with the user interface 116. For example, the touchscreen 148 could provide information to a user of vehicle 100. The user interface 116 could also be operable to accept input from the user via the touchscreen 148. In other instances, the peripherals 108 may provide means for the vehicle 100 to communicate with devices within its environment.

In one example, the wireless communication system 146 could be configured to wirelessly communicate with one or more devices directly or via a communication network. For example, wireless communication system 146 could use 3G cellular communication, such as CDMA, EVDO, GSM/GPRS, or 4G cellular communication, such as WiMAX or LTE. Alternatively, wireless communication system 146 could communicate with a wireless local area network (WLAN), for example, using WiFi. In some embodiments, wireless communication system 146 could communicate directly with a device, for example, using an infrared link, Bluetooth, or ZigBee. Other wireless protocols, such as various vehicular communication systems, are possible within the context of the disclosure. For example, the wireless communication system 146 could include one or more dedicated short range communications (DSRC)

devices that could include public and/or private data communications between vehicles and/or roadside stations.

The power supply 110 may provide power to various components of vehicle 100 and could represent, for example, a rechargeable lithium-ion or lead-acid battery. In an example embodiment, one or more banks of such batteries could be configured to provide electrical power. Other power supply materials and types are possible. Depending upon the embodiment, the power supply 110, and energy source 119 could be integrated into a single energy source, such as in some all-electric cars.

Many or all of the functions of vehicle 100 could be controlled by computer system 112. Computer system 112 may include at least one processor 113 (which could include at least one microprocessor) that executes instructions 115 stored in a non-transitory computer readable medium, such as the data storage 114. The computer system 112 may also represent a plurality of computing devices that may serve to control individual components or subsystems of the vehicle 100 in a distributed fashion.

In some embodiments, data storage 114 may contain instructions 115 (e.g., program logic) executable by the processor 113 to execute various functions of vehicle 100, including those described above in connection with FIG. 1. Data storage 114 may contain additional instructions as well, including instructions to transmit data to, receive data from, interact with, and/or control one or more of the propulsion system 102, the sensor system 104, the control system 106, and the peripherals 108.

In addition to the instructions 115, the data storage 114 may store data such as roadway maps, path information, among other information. Such information may be used by vehicle 100 and computer system 112 during the operation of the vehicle 100 in the autonomous, semi-autonomous, and/or manual modes.

The vehicle 100 may include a user interface 116 for providing information to or receiving input from a user of vehicle 100. The user interface 116 could control or enable control of content and/or the layout of interactive images that could be displayed on the touchscreen 148. Further, the user interface 116 could include one or more input/output devices within the set of peripherals 108, such as the wireless communication system 146, the touchscreen 148, the microphone 150, and the speaker 152.

The computer system 112 may control the function of the vehicle 100 based on inputs received from various subsystems (e.g., propulsion system 102, sensor system 104, and control system 106), as well as from the user interface 116. For example, the computer system 112 may utilize input from the sensor system 104 in order to estimate the output produced by the propulsion system 102 and the control system 106. Depending upon the embodiment, the computer system 112 could be operable to monitor many aspects of the vehicle 100 and its subsystems. In some embodiments, the computer system 112 may disable some or all functions of the vehicle 100 based on signals received from sensor system 104.

The components of vehicle 100 could be configured to work in an interconnected fashion with other components within or outside their respective systems. For instance, in an example embodiment, the camera 130 could capture a plurality of images that could represent information about a state of an environment of the vehicle 100 operating in an autonomous mode. The state of the environment could include parameters of the road on which the vehicle is operating. For example, the computer vision system 140 may be able to recognize the slope (grade) or other features based on the plurality of images of a roadway. Additionally, the combination of Global Positioning System 122 and the features recognized by the computer vision system 140 may be used with map data stored in the data storage 114 to determine specific road parameters. Further, the radar unit 126 may also provide information about the surroundings of the vehicle.

A combination of various sensors (which could be termed input-indication and output-indication sensors), such as described above, and the computer system 112 could interact to provide an indication of an input provided to control a vehicle or an indication of the surroundings of a vehicle.

The computer system 112 could carry out several determinations based on the indications received from the input- and output-indication sensors. For example, the computer system 112 could calculate the direction (i.e. angle) and distance (i.e. range) to one or more objects that are reflecting radar signals back to the radar unit 126. Additionally, the computer system 112 could calculate a range of interest. The range of interest could, for example, correspond to a region where the computer system 112 has identified one or more targets of interest. Additionally, the computer system 112 may identify one or more undesirable targets. Thus, a range of interest may be calculated so as not to include undesirable targets.

In some embodiments, the computer system 112 may make a determination about various objects based on data that is provided by systems other than the radar system. For example, the vehicle may have lasers or other optical sensors configured to sense objects in a field of view of the vehicle. The computer system 112 may use the outputs from the various sensors to determine information about objects in a field of view of the vehicle. The computer system 112 may determine distance and direction information to the various objects. The computer system 112 may also determine whether objects are desirable or undesirable based on the outputs from the various sensors.

Although FIG. 1 shows various components of vehicle 100, i.e., wireless communication system 146, computer system 112, data storage 114, and user interface 116, as being integrated into the vehicle 100, one or more of these components could be mounted or associated separately from the vehicle 100. For example, data storage 114 could, in part or in full, exist separate from the vehicle 100. Thus, the vehicle 100 could be provided in the form of device elements that may be located separately or together. The device elements that make up vehicle 100 could be communicatively coupled together in a wired and/or wireless fashion.

Figure 2:
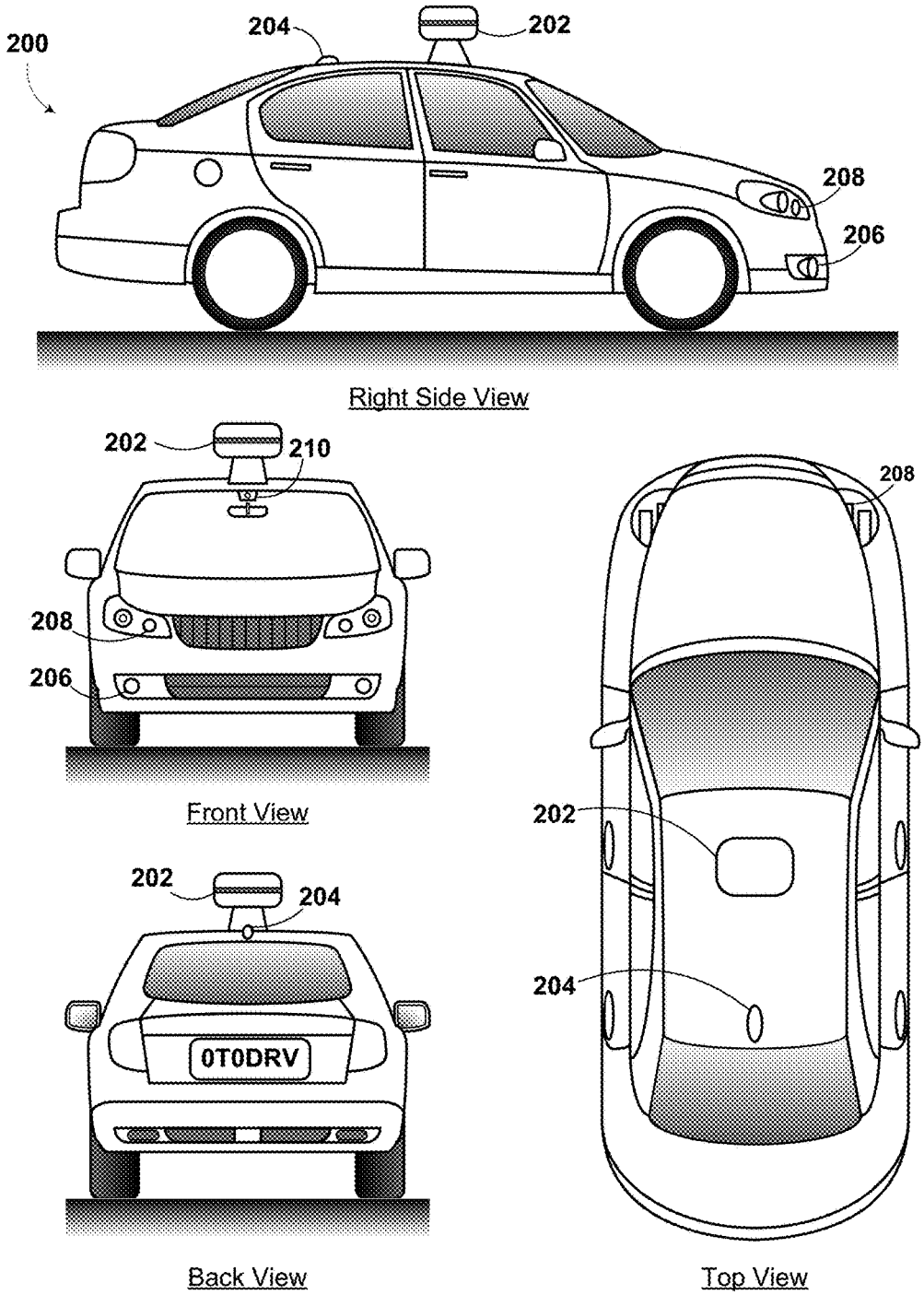
FIG. 2 shows a vehicle, according to an example embodiment.

FIG. 2 shows a vehicle 200 that could be similar or identical to vehicle 100 described in reference to FIG. 1. Depending on the embodiment, vehicle 200 could include a sensor unit 202, a wireless communication system 204, a radar 206, a laser rangefinder 208, and a camera 210. The elements of vehicle 200 could include some or all of the elements described for FIG. 1. Although vehicle 200 is illustrated in FIG. 2 as a car, other embodiments are possible. For instance, the vehicle 200 could represent a truck, a van, a semi-trailer truck, a motorcycle, a golf cart, an off-road vehicle, or a farm vehicle, among other examples.

The sensor unit 202 could include one or more different sensors configured to capture information about an environment of the vehicle 200. For example, sensor unit 202 could include any combination of cameras, radars, LIDARs, range finders, and acoustic sensors. Other types of sensors are possible. Depending on the embodiment, the sensor unit 202 could include one or more movable mounts that could be operable to adjust the orientation of one or more sensors in the sensor unit 202. In one embodiment, the movable mount could include a rotating platform that could scan sensors so as to obtain information from each direction around the vehicle 200. In another embodiment, the movable mount of the sensor unit 202 could be moveable in a scanning fashion within a particular range of angles and/or azimuths. The sensor unit 202 could be mounted atop the roof of a car, for instance, however other mounting locations are possible. Additionally, the sensors of sensor unit 202 could be distributed in different locations and need not be collocated in a single location. Some possible sensor types and mounting locations include radar 206 and laser rangefinder 208.

The wireless communication system 204 could be located as depicted in FIG. 2. Alternatively, the wireless communication system 204 could be located, fully or in part, elsewhere. The wireless communication system 204 may include wireless transmitters and receivers that could be configured to communicate with devices external or internal to the vehicle 200. Specifically, the wireless communication system 204 could include transceivers configured to communicate with other vehicles and/or computing devices, for instance, in a vehicular communication system or a roadway station. Examples of such vehicular communication systems include dedicated short range communications (DSRC), radio frequency identification (RFID), and other proposed communication standards directed towards intelligent transport systems.

The camera 210 could be mounted inside a front windshield of the vehicle 200. The camera 210 could be configured to capture a plurality of images of the environment of the vehicle 200. Specifically, as illustrated, the camera 210 could capture images from a forward-looking view with respect to the vehicle 200. Other mounting locations and viewing angles of camera 210 are possible. The camera 210 could represent one or more visible light cameras. Alternatively or additionally, camera 210 could include infrared sensing capabilities. The camera 210 could have associated optics that could be operable to provide an adjustable field of view. Further, the camera 210 could be mounted to vehicle 200 with a movable mount that could be operable to vary a pointing angle of the camera 210.

Figure 3A:
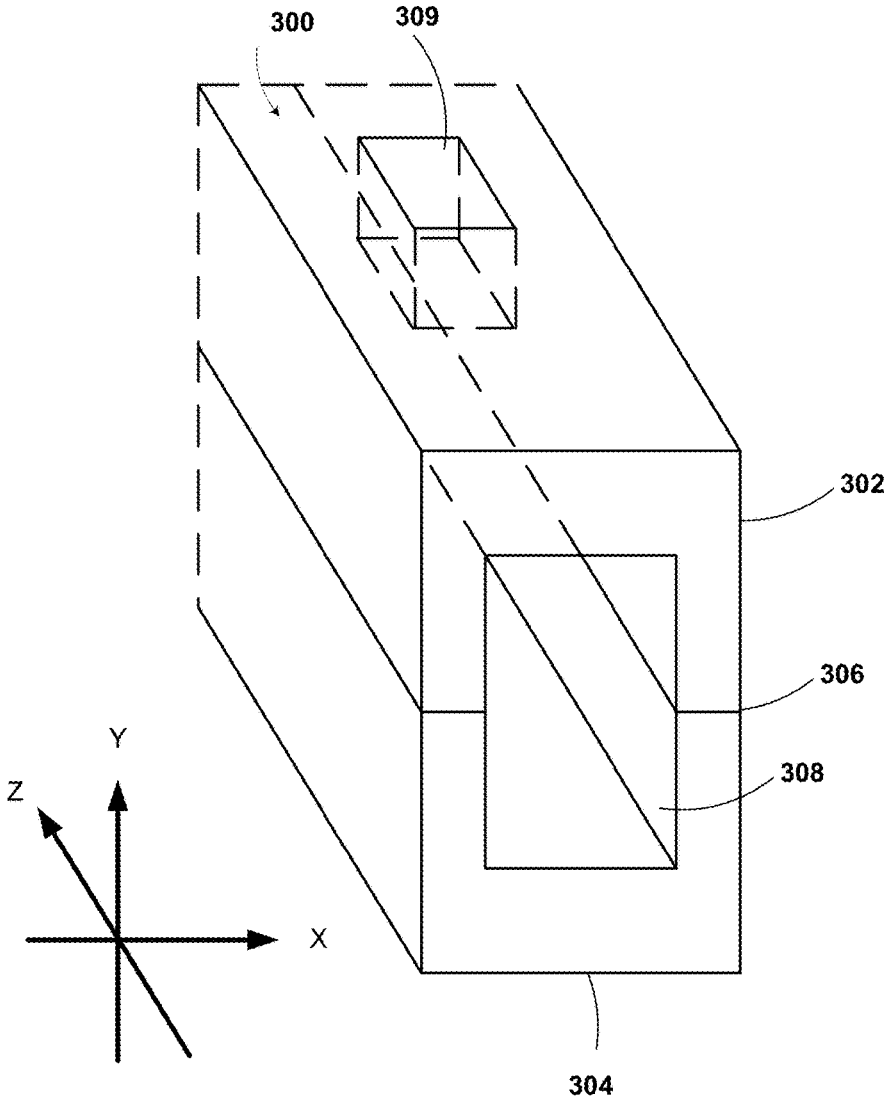
FIG. 3A illustrates an example isometric cross-section view of a waveguide.

FIG. 3A illustrates an example isometric cross-section view of a waveguide 300. The example waveguide 300 is formed with a top portion 302 and a bottom portion 304. The top portion 302 and a bottom portion 304 are coupled at seam 306. The waveguide includes a cavity 308. Within cavity 308, electromagnetic energy propagates during the operation of waveguide 300. The waveguide 300 may also include a feed 309. Feed 309 can be used to provide electromagnetic energy to cavity 308 in waveguide 300. Alternatively or additionally, feed 309 may be used to allow electromagnetic energy to leave waveguide 300. The example waveguide 300 of FIG. 3A features seam 306 at the middle point of the height of cavity 308. In various embodiments, the top portion 302 and a bottom portion 304 may be coupled together at various different positions along an axis of the waveguide.

Figure 3B:
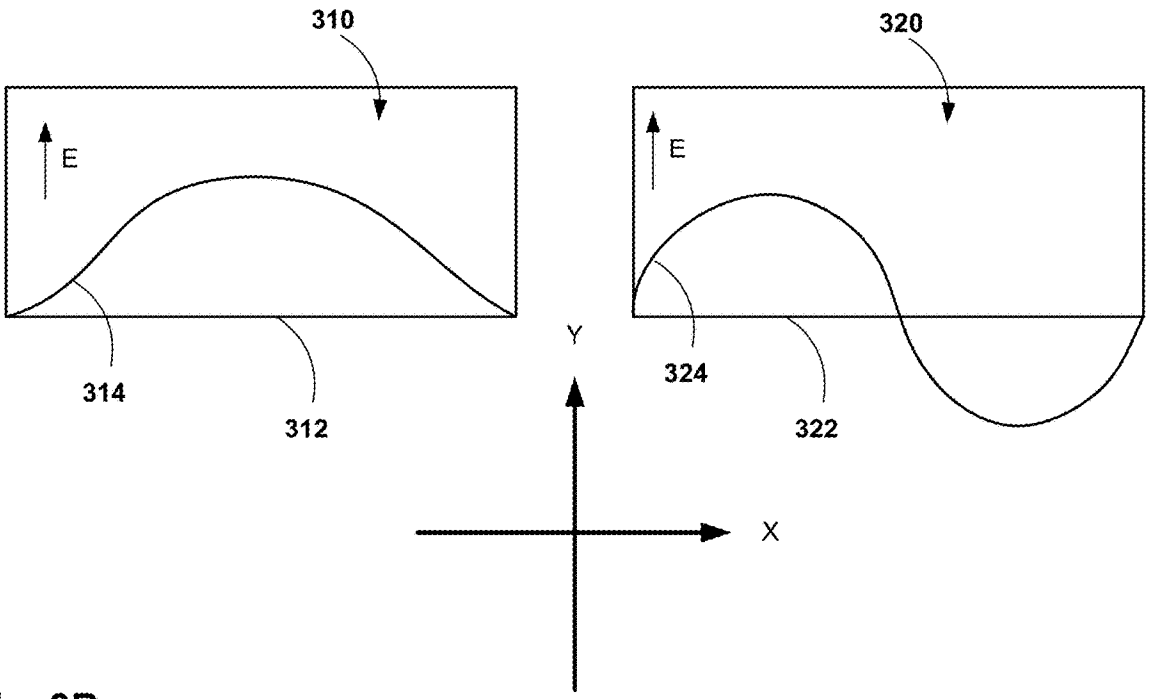
FIG. 3B illustrates two examples of modes operating in waveguides.

FIG. 3B illustrates two examples of modes operating in waveguides. Mode 310 is an example of a $TE_{10}$ mode operating in a cross section of metallic waveguide 312. Mode 320 is an example $TE_{20}$ mode operating in a cross section of metallic waveguide 322. Mode 310 and Mode 320 each have respective electromagnetic energy propagating down the length of the waveguide. As shown in FIG. 3A, the electromagnetic energy will propagate through the respective waveguides in a direction either in-to or out-of the page (i.e. along the Z-axis).

Because the example waveguide 312 and waveguide 322 are metallic, each has a similar set of boundary conditions. The boundary conditions result from specific physical phenomena that occur due to physics and the materials that form the waveguide. For example, in the metallic waveguide, assuming the waveguide walls are nearly perfectly conducting, the boundary conditions specify that there is no tangential electric field at any of the wall sides. Therefore, when a TE mode is conducted by the waveguide, there is no electric field at the location of a wall of the waveguide (where the wall is in the same direction as the electric field).

As shown in FIG. 3B, the example electric field of the electromagnetic energy is pointed in the vertical direction. Due to the boundary conditions, there is no vertically oriented electric field at the vertical walls of the waveguide. Therefore, for any propagation mode of electromagnetic energy to exist in the waveguide, the electric field has a value of zero in the vertical direction at the walls of the waveguide.

Waveguide 310 is an example of a $TE_{10}$ mode operating in a cross section of metallic waveguide 312. As previously discussed, the suffix 10 indicates the waveguide dimension is equal to one-half of the wavelength of the electromagnetic energy along the width of waveguide 310. However, the suffix number of zero indicates there is no variation of the field with respect to the vertical direction. Because all TE modes have a magnetic field that is transverse (i.e. perpendicular) to the direction of propagation of the electromagnetic energy, and the energy is propagating either into or out of the page, the electric field of mode 310 is completely in the vertical direction. Curve 314 indicates the relative electric field strength of mode 310 as a function of horizontal position in waveguide 312. As was already discussed with the boundary conditions, the electric field of mode 310 goes to zero at the edges of the waveguide 312. Further, the electric field of mode 310 has a maximum in the center of the waveguide 312.

As previously discussed, at the point along the surface of the waveguide 312 that corresponds to the position where the electric field is a maximum, the current induced in the waveguide 312 is at a minimum. However, at the point along the surface of the waveguide 312 that corresponds to the position where the electric field is a minimum, the current induced in the waveguide 312 is at a maximum.

Mode 320 is an example $TE_{20}$ mode operating in a cross section of metallic waveguide 322. The suffix 20 indicates the waveguide dimension is equal to a full wavelength (i.e. two half wavelengths) of the wavelength of the electromagnetic energy along the width of waveguide 322 and the zero indicates there is no variation of the field with respect to the vertical direction. Curve 324 indicates the relative electric field strength of mode 320 as a function of horizontal position in the waveguide 322. As was already discussed with the boundary conditions, the electric field of mode 320 goes to zero at the edges of the waveguide 322. Additionally, the electric field of mode 320 is equal to zero at the middle point of the X-axis. Further, the absolute value of the electric field of mode 320 has two maxima in waveguide 322, a maximum at one-quarter of the width and a maximum at three quarters of the width of waveguide 312. As indicated by curve 324, the electric field will have different signs at these two absolute maxima (one being positive and the other being negative), however the positive and negative maxima may change positions with each other depending on the specific embodiment.

FIG. 3B presents a $TE_{10}$ and a $TE_{20}$ mode. However, the systems and methods disclosed herein, may work with other modes of electromagnetic propagation as well. For example, $TE_{01}$ and a $TE_{02}$ modes would operate virtually identically to $TE_{10}$ and a $TE_{20}$ modes, except for being rotated 90 degrees (i.e. the electric field would be horizontally aligned rather than vertically). Further, higher order modes, such as $TE_{30}$ and a $TE_{21}$ may be used as well. Additionally, TM may also be used with the systems and methods disclosed herein. For simplicity, each mode is not shown in a figure.

Figure 4:
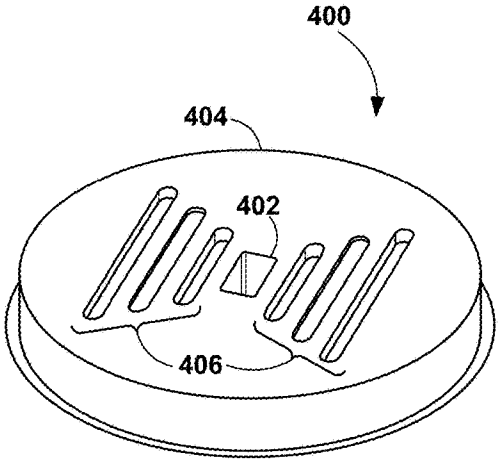
FIG. 4 illustrates an example free-space matched waveguide flange.

Waveguides, such as those described with respect to FIGS. 3A and 3B may be used on both the vehicle as well as part of a radar calibration and/or measurement device. FIG. 4 illustrates an example free-space matched waveguide flange 400. As shown in a FIG. 4, the flange 400 includes a waveguide port 402 coupled to a surface of the flange 404. The flange 400 also includes radiating elements 406 on the surface of the flange 404. As shown in FIG. 4, the radiating elements 406 may be radiating slots. In some examples, the radiating elements 406 may be elements other than radiating slots, such as radiating cavities, or any other radiating structure.

Additionally, the free-space matched waveguide flange 400 may also include mounting components (not shown), such as screw holes, that enable the free-space matched waveguide flange 400 to be coupled to other devices. For example, the free-space matched waveguide flange 400 may enable an antenna to be coupled to radiate (or receive) signals from (or to) the waveguide port 402. In other examples, the free-space matched waveguide flange 400 may be able to be coupled to another waveguide flange to conduct signals from the waveguide port 402 of the free-space matched waveguide flange 400 to waveguide port of a subsequent waveguide flange.

The free-space matched waveguide flange 400 may be used as a termination on a waveguide system. For example, the free-space matched waveguide flange 400 may be coupled to waveguides of a radar system of a vehicle. In other examples, the free-space matched waveguide flange 400 may be coupled to waveguides used in a radar testing system, such as the testing of a radar system of a vehicle.

Typically, a waveguide has a predetermined characteristic impedance. Normally the waveguide is operated with a character impedance of about 500 Ohms (Ω). The characteristic impedance is based on the waveguide dimensions, a frequency of operation of a waveguide, and the waveguide operation mode. Equation 1-3 below can be used to calculate the characteristic impedance for a respective waveguide based on whether the waveguide is being operated in a TEM, TE, or TM mode (as previously discussed). In the following equations, Z represents impedance, β is the phase constant for a wave in the waveguide, η is the wave impedance for the given material filling the waveguide, k is the wavenumber of the of the signal in the waveguide, and ω is the angular frequency of the signal in the waveguide, in radians.

$$Z_{TEM} = \sqrt{\frac{\mu}{\epsilon}} = \eta \quad \text{Equation 1}$$

$$Z_{TE} = \frac{\omega\mu}{\beta} = \frac{k\eta}{\beta} \quad \text{Equation 2}$$

$$Z_{TM} = \frac{\beta}{\omega\epsilon} = \frac{\beta\eta}{k} \quad \text{Equation 3}$$

Further, free space (that is, the area outside the waveguide) has a characteristic impedance of approximately 377Ω. Consequently, when a signals are traveling down a waveguide having a characteristic impedance of approximately 500Ω and reaches the end of the waveguide that is free space having a characteristic impedance of approximately 377Ω, there is a large discontinuity in impedance seen by the signals. When signals reach the discontinuity, due to the impedance mismatch, a portion of the signal may be reflected backward. For example, a signal may be reflected back into the waveguide in the opposite direction from which it was originally propagating. This reflected energy may cause errors in the system into which the energy reflects. Therefore, it is generally desirable to match impedances in order to reduce unintentional energy reflections.

In many typical systems, a designer has two options. First, an impedance transformer, such as an antenna, may be mated to the waveguide. The antenna transforms the impedance of the waveguide to approximately the impedance of free space. Thus, signals from the waveguide may propagate from the waveguide into free space with little reflection. A second option is to terminate the waveguide with a matched load. A matched load essentially would absorb the signal that is traveling down the waveguide. Thus, the energy would not radiate, but it also would not reflect back into the system. While both of these solutions may mitigate waveguide reflections from an impedance continuity, both may be labor intensive while testing a system. As various waveguides are used, each may need to have either an antenna or a matched load coupled to the waveguide port 402 of a respective waveguide. Therefore, when testing, a lot of labor may be used manually attaching antennas and loads to the various waveguides of a system. The presently disclosed free-space matched waveguide flange 400 may reduce manual labor required to test waveguide systems and may also provide for more accurate results in testing waveguide systems.

During the operation of the free-space matched waveguide flange 400, a signal may be conducted through a waveguide to the waveguide port 402. With a traditional waveguide flange, the signal may see an impedance discontinuity when it reaches free space at a waveguide port. However, with the free-space matched waveguide flange 400, the signal may see an impedance match when it reaches the waveguide port 402. The addition of radiating components 406 on the surface 404 of the free-space matched waveguide flange 400 are used to create the impedance match. Although the term impedance match is used, the impedance seen from the waveguide may not perfectly match that of free space, but it may be sufficiently close to reduce the amount of energy reflected back into the waveguide.

When the signal reaches the waveguide port 402, it may induce a surface current across the surface 404 of the free-space matched waveguide flange 400. A surface current is an electromagnetic current that is induced on the surface 404 by the signal that exits the waveguide port 402. The radiating components 406 interrupt the surface current and cause the signal from the waveguide port 402 to radiate into free space. In essence, the radiating components 406 cause the free-space matched waveguide flange 400 to function as an antenna. Various other shapes and structures may be used for the radiating structures 406, which are shown as slots in FIG. 4.

Figure 5:
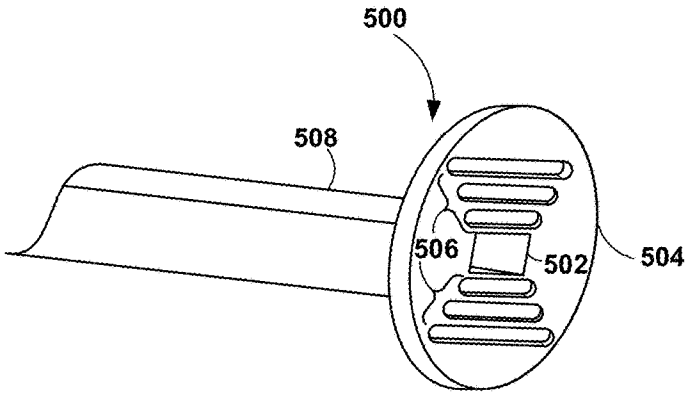
FIG. 5 illustrates an example free-space matched waveguide flange and waveguide.

FIG. 5 illustrates an example free-space matched waveguide flange 500 and waveguide 508. As shown in FIG. 5, there is a waveguide port 502, a flange surface 504, radiating components 506, and a waveguide 508. The waveguide 508 is coupled to the waveguide port 502. The waveguide 508 is configured to conduct electromagnetic energy to and from the waveguide port 502. The free-space matched waveguide flange 500 is similar to that shown in FIG. 4. FIG. 5 includes the waveguide 508 that couples to the waveguide port 502.

Figure 6:
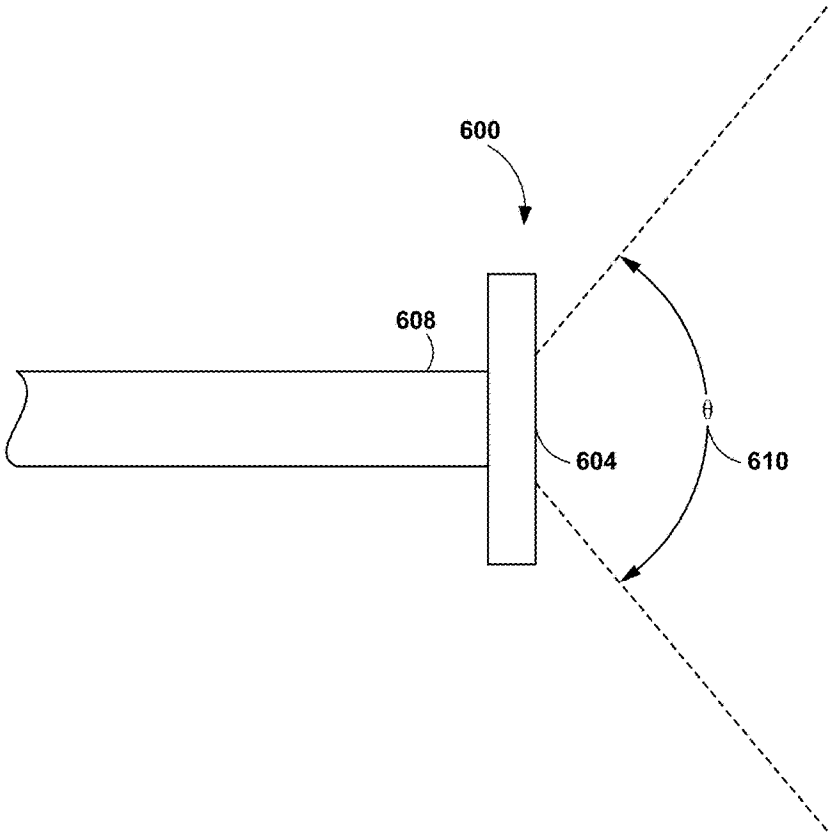
FIG. 6 illustrates an example free-space matched waveguide flange and waveguide having a radiation pattern.

FIG. 6 illustrates an example free-space matched waveguide flange 600 and waveguide 608 having a radiation pattern 610. The free-space matched waveguide flange 600 may be similar to that of of both FIGS. 4 and 5. The free-space matched waveguide flange 600 is shown from a side angle. The free-space matched waveguide flange 600 has a surface 604. The surface 604 has both a waveguide port (not shown) and radiating elements (not shown) that are similar to those previously described with respect to the other figures. The waveguide port is coupled to the waveguide 608.

When a signal from the waveguide 608 reaches the waveguide port, it may cause a surface current on the surface 604 of the free-space matched waveguide flange 600. The surface current on the surface 604 may interact with the radiating elements on the surface 604 and cause the radiation of the signal into free space.

As previously discussed, the addition of radiating elements to the surface 604 of the free-space matched waveguide flange 600 cause the free-space matched waveguide flange 600 to function as an antenna. The design of the radiating elements may cause the radiated signal to have an associated radiation pattern 610. The radiation pattern 610 may have a beam width of 0 degrees. Thus, when a signal from the waveguide 608 reaches the waveguide port, it may be radiated in a similar manner as if an antenna was coupled to the surface 604 of the free-space matched waveguide flange 600. In practice, a signal propagating down the waveguide 608 may see the waveguide port as being impedance matched to the waveguide itself. Accordingly, the free-space matched waveguide flange 600 may function as an impedance transformer, to transform the characteristic impedance of the waveguide 608 to the characteristic impedance of free space.

A further benefit of the free-space matched waveguide flange 600 radiating signals similar to an antenna is that the radiated signals may be measured in the far field to assess system performance. For example, when a waveguide system is in use, it may generally be difficult to measure signals within a respective waveguide 608. If a waveguide can be left open and have a free-space matched waveguide flange 600 coupled to the open portion of the waveguide 608, the signal within the waveguide 608 will be radiated and can be measured outside of the waveguide. Therefore, the signal properties of the signal within the waveguide can be determined based on measuring the radiated signal.

Conversely, the free-space matched waveguide flange 600 may also be used to receive signals from free space. The radiating elements of the waveguide surface 604 may capture signals from free space and conduct the signals into the waveguide 608. Therefore, in some examples, signals may be injected into a waveguide system through the use of a free-space matched waveguide flange 600.

Figure 7A:
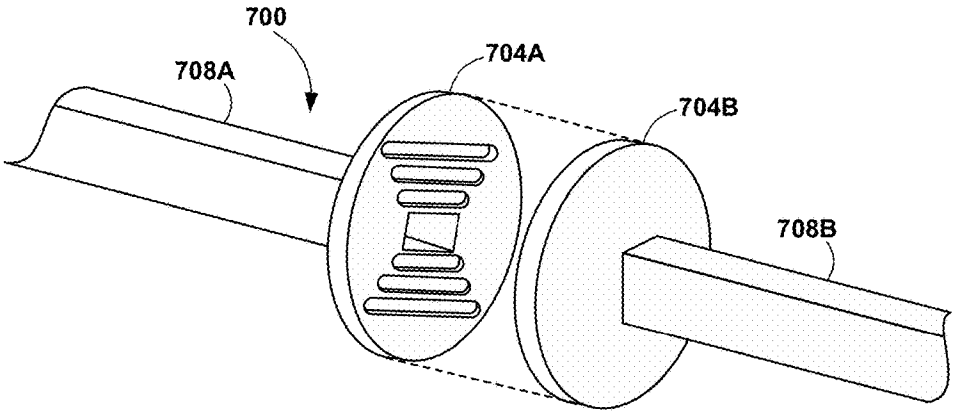
FIG. 7A illustrates two example waveguide flanges in an uncoupled position.
Figure 7B:
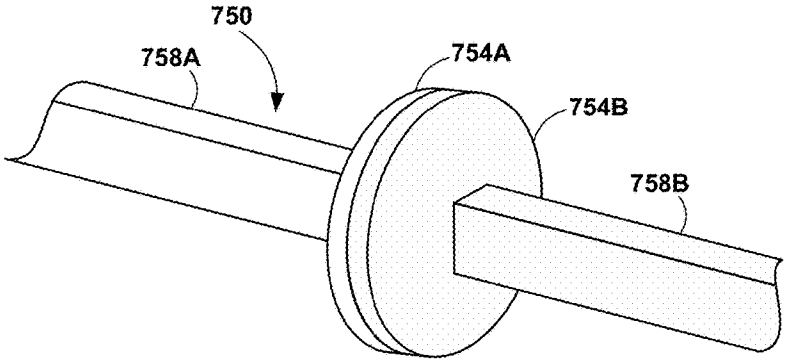
FIG. 7B illustrates two example waveguide flanges in a coupled position.

FIG. 7A illustrates two example waveguide flanges in an uncoupled position and FIG. 7B illustrates two example waveguide flanges in a coupled position. In FIG. 7A, the coupling 700 of a free-space matched waveguide flange 704A to a second waveguide flange 704B is shown. The free-space matched waveguide flange 704A may be backward compatible with tradition waveguide flanges (i.e. waveguide flanges that do not have radiating components integrated on the flange surface). The free-space matched waveguide flange 704A is coupled to a waveguide 708A and the second waveguide flange 704B is coupled to a waveguide 708B.

Both the free-space matched waveguide flange 704A and the second waveguide flange 704B may include a coupling means, such as screw holes, in order to physically couple the two flanges together. In other examples, various other coupling means may be used as well, such as springs, clips, contact, or any other suitable way to couple the two flanges. Additionally, the second waveguide flange 704B may include radiating elements, as described with respect to the free-space matched flanges or it may be a traditional flange without radiating components. FIG. 7B shows the flanges of FIG. 7A once they are coupled.

In FIG. 7B, the coupled flanges 750 include a free-space matched waveguide flange 754A coupled to a second waveguide flange 754B. The free-space matched waveguide flange 754A is coupled to a waveguide 758A and the second waveguide flange 754B is coupled to a waveguide 758B. Once the two flanges 754A and 754B are coupled, a signal from the waveguide 758A may flow into waveguide 758B.

When the two flanges 754A and 754B are coupled together, the radiating elements of the free-space matched waveguide flange 754A are shorted against the second waveguide flange 754B. By shorting the radiating components, the function of the radiating components may be removed from the flange. In practice, when the radiating components are shorted to the second flange, the free-space matched waveguide flange 754A may function just as a traditional flange would. The free-space transformation properties are removed when the radiating components are shorted. However, the free-space matched waveguide flange 754A allows a signal in the waveguide 758A to couple into the waveguide 758B by way of the second flange 754B. When the radiating components are shorted, the impedance seen by a signal in the waveguide 758A as it exits free-space matched waveguide flange 754A and enters the second flange 754B is the characteristic impedance of waveguide 758B. If the characteristic impedance of waveguide 758A is the same as the characteristic impedance of waveguide 758B, then the signal will propagate freely with no reflections.

Figure 8:
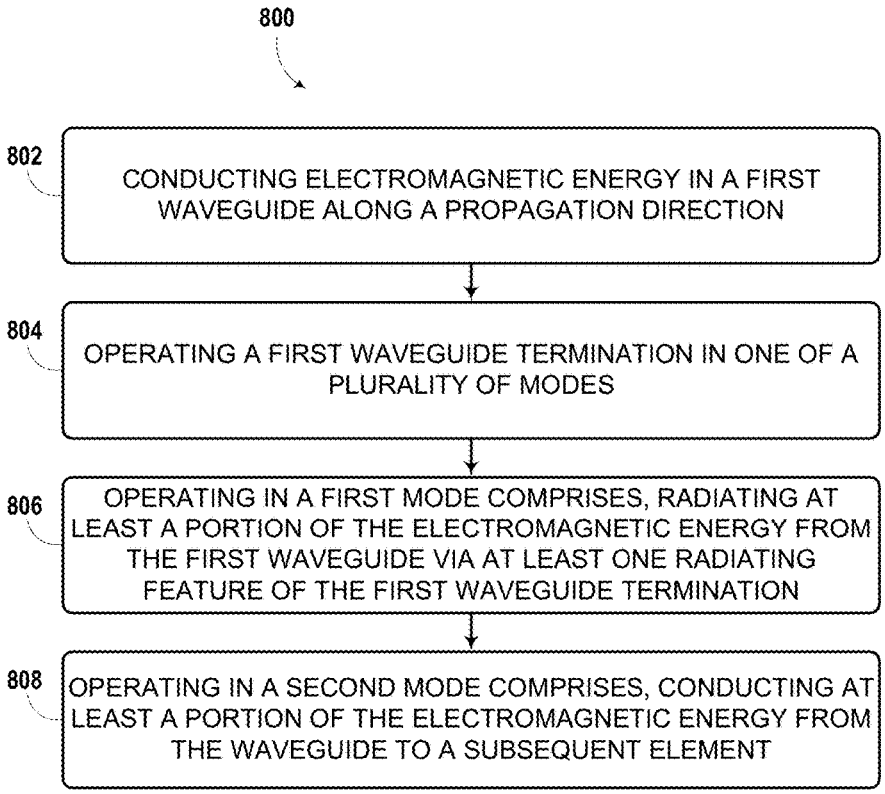
FIG. 8 illustrates a method of operating a free-space matched waveguide flange.

FIG. 8 illustrates a method of operating a first waveguide and first waveguide flange. The first waveguide flange could be a free-space matched waveguide flange, as illustrated in FIGS. 4-7B and discussed above. Further, FIG. 8 generally relates to a method whereby an electromagnetic signal exists in a waveguide. However, the free-space matched waveguide flange may also be used with methods where an electromagnetic signal exists in free space and is coupled into a waveguide.

At block 802, the method includes conducting electromagnetic energy in a first waveguide along a propagation direction. As previously discussed, a waveguide can conduct electromagnetic energy in a low loss manner. At block 802, electromagnetic energy is conducted in a waveguide along a propagation direction to a waveguide flange, such as a waveguide flange.

At block 804, the method includes operating a first waveguide flange in one of a plurality of modes. The first waveguide flange may operate in the first mode when the first waveguide flange is left open, similar to FIG. 6 as shown above. The first waveguide flange may operate in the second mode when the first waveguide flange is coupled to a subsequent element, such as a second waveguide flange, similar to as shown in FIG. 7B above.

At block 806, the method includes operating in a first mode, which comprises radiating at least a portion of the electromagnetic energy from the first waveguide via at least one radiating feature of the first waveguide flange. The at least one radiating feature is located on a surface of the first waveguide flange that is perpendicular to the direction of propagation. As previously discussed, when an electromagnetic signal reaches the waveguide port of the first waveguide flange (e.g. flange), the electromagnetic signal may form a surface current across the surface of the waveguide flange. The waveguide flange may have radiating components that cause the flange to radiate the electromagnetic signal from the surface of the flange into free space. Additionally, when operating in the first mode, the first waveguide flange may function as an impedance transformer to transform the characteristic impedance within the waveguide to the characteristic impedance of free space.

At block 808, the method operating in a second mode, which comprises conducting at least a portion of the electromagnetic energy from the waveguide to a subsequent element. At block 808, the at least one radiating feature is shorted to a portion of the subsequent element. The subsequent element may be a waveguide flange of a subsequent waveguide.

When the two flanges are coupled together, the radiating elements of the flange is shorted against the second flange, as previously discussed with respect to FIG. 7B. By shorting the radiating components, the function of the radiating components may be removed. In practice, when the radiating components are shorted the impedance transformation properties are removed. When the radiating components are shorted, the impedance seen by a signal in the waveguide as it exits free-space matched flange and enters the second flange is the characteristic impedance of the second waveguide.

It should be understood that arrangements described herein are for purposes of example only. As such, those skilled in the art will appreciate that other arrangements and other elements (e.g. machines, apparatuses, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. A system comprising:

a first waveguide configured to propagate electromagnetic energy along a propagation direction; and a first waveguide flange configured to selectively operate in one of a plurality of modes, wherein:

operating in a first mode comprises radiating at least a portion of the electromagnetic energy from the first waveguide via a plurality of radiating features of the first waveguide flange, wherein the plurality of radiating features are located on a surface of the first waveguide flange that is perpendicular to the propagation direction, and operating in a second mode comprises conducting at least a portion of the electromagnetic energy from the first waveguide to a subsequent element, wherein the plurality of radiating features are shorted to a portion of the subsequent element.

2. The system according to claim 1, wherein when operating in the first mode, the first waveguide flange has an impedance approximately equal to a characteristic impedance of the first waveguide.

3. The system according to claim 2, wherein when operating in the first mode, the first waveguide flange functions as an impedance transformer to match the characteristic impedance of the first waveguide to an impedance of free space.

4. The system according to claim 1, wherein the radiated electromagnetic energy has an associated, predetermined radiation pattern such that performance measurements may be calculated by measuring a far field of the electromagnetic energy.

5. The system according to claim 1, wherein when operating in the second mode, the subsequent element comprises a second waveguide flange configured to couple to the first waveguide flange.

6. The system according to claim 5, wherein the second waveguide flange is coupled to a second waveguide having a characteristic impedance equal to a characteristic impedance of the first waveguide.

7. The system according to claim 1, wherein the plurality of radiating features are is at least one radiating cavity.

8. A method comprising:

conducting electromagnetic energy in a first waveguide along a propagation direction; and operating a first waveguide flange in one of a plurality of modes, wherein:

operating in a first mode comprises radiating at least a portion of the electromagnetic energy from the first waveguide via a plurality of radiating features of the first waveguide flange, wherein the plurality of radiating features are located on a surface of the first waveguide flange that is perpendicular to the propagation direction, and operating in a second mode comprises conducting at least a portion of the electromagnetic energy from the first waveguide to a subsequent element, wherein the plurality of radiating features are shorted to a portion of the subsequent element.

9. The method according to claim 8, wherein operating in the first mode further comprises radiating electromagnetic energy with an associated, predetermined radiation pattern such that performance measurements may be calculated by measuring a far field of the electromagnetic energy.

10. The method according to claim 8, wherein operating in the first mode further comprises radiating electromagnetic energy by at least one radiating slot.

11. The method according to claim 8, wherein the subsequent element comprises a second waveguide flange, and wherein operating in the second mode further comprises, coupling to the second waveguide flange.

12. The method according to claim 11, wherein operating in the second mode further comprises conducting at least a portion of the electromagnetic energy to a second waveguide coupled to the second waveguide flange, wherein the second waveguide has a characteristic impedance equal to a characteristic impedance of the first waveguide.

13. The method according to claim 8, further comprising when operating in the first mode, transforming an impedance from a characteristic impedance of the first waveguide to an impedance of free space.

14. A system comprising:

a first waveguide configured to propagate electromagnetic energy along a propagation direction; and a first waveguide flange configured to selectively operate in one of a plurality of modes, wherein:

operating in a first mode comprises radiating at least a portion of the electromagnetic energy from the first waveguide via a plurality of radiating features of the first waveguide flange, wherein the plurality of radiating features are located on a surface of the first waveguide flange that is perpendicular to the propagation direction, and operating in a second mode comprises conducting at least a portion of the electromagnetic energy from the first waveguide to a second waveguide coupled to the first waveguide via the first waveguide flange and a second waveguide flange, wherein when operating in the second mode, the second waveguide flange is configured to short the plurality of radiating features of the first waveguide flange.

15. The system according to claim 14, wherein when operating in the first mode, the first waveguide flange has an impedance approximately equal to a characteristic impedance of the first waveguide.

16. The system according to claim 14, wherein when operating in the first mode, the first waveguide flange functions as an impedance transformer to match a characteristic impedance of the first waveguide to an impedance of free space.

17. The system according to claim 14, wherein the radiated electromagnetic energy has an associated, predetermined radiation pattern such that performance measurements may be calculated by measuring a far field of the electromagnetic energy.

18. The system according to claim 14, wherein when operating in the second mode, the electromagnetic energy propagates freely from the first waveguide to the second waveguide with no reflections.

19. The system according to claim 14, wherein the second waveguide has a characteristic impedance equal to a characteristic impedance of the first waveguide.

20. The system according to claim 14, wherein the plurality of radiating features are at least one radiating slot.

* * * * *